United States Patent [19]

Santos, Jr. et al.

[11] 4,059,861

[45] Nov. 29, 1977

[54] WET LATEX LASTING SYSTEM

[75] Inventors: John J. Santos, Jr., N. Attleboro; Joseph V. Tassone, Milford, both of Mass.

[73] Assignee: Compo Industries, Inc., Waltham, Mass.

[21] Appl. No.: 691,548

[22] Filed: June 1, 1976

[51] Int. Cl.[2] ..... A43D 21/00

[52] U.S. Cl. ..... 12/145

[58] Field of Search ..... 12/145, 146 BP, 8.3

[56] References Cited

U.S. PATENT DOCUMENTS

| | | | |
|---|---|---|---|
| 2,688,759 | 9/1954 | Clark | 12/146 BP |
| 2,945,247 | 7/1960 | Kamborian et al. | 12/8.3 |
| 2,970,330 | 2/1961 | Kamborian | 12/8.3 |
| 3,315,288 | 4/1967 | Forma | 12/145 |

*Primary Examiner*—Patrick D. Lawson

*Attorney, Agent, or Firm*—Dike, Bronstein, Roberts, Cushman & Pfund

[57] ABSTRACT

The method of wet lasting the lasting margin of a shoe upper to the marginal edge of the bottom structure which comprises, progressively lasting the lasting margin of an upper to the margin of a bottom structure which has along its margin at least, a dry receptive adhesive coating and while so lasting the margin applying a liquid coating of latex in a controlled amount to the inner side of the lasting margin just before it is laid down.

4 Claims, 11 Drawing Figures

WET LATEX LASTING SYSTEM

BACKGROUND OF INVENTION

The construction of California of slip lasted women's shoes which is used in American shoe factories today includes the preparation of an upper with a sewed-in sock lining and a sewed-on platform cover. In most of these shoes today a platform of ¼ inch – ⅜ inch is not used as it was in the past but simply a conventional 5 or 6 iron insole consisting of a bonded fiber material such as Texon with a fiber tuck material in the shank and heel seat. The platform cover is lasted over the insole all around the shoe, creating a relatively thin platform or bead look between the upper and the outsole. After the lasting of the cover, the lasted margin of the cover is roughed and cemented with a precemented sole then attached in the normal fashion.

At the present time, the cover lasting operation is performed on roll-type side or cover lasting machines with hot melt cement being applied during the lasting operation or with the lasting cement being applied to the cover and the insole prior to lasting. When precementing is performed, the adhesive used is natural rubber latex sprayed with a spray gun onto the lasting margin portion of the insole and the upstanding lasting margin of the cover.

It has been found that the method and machine described in our United States patent application Ser. No. 529,458 can be effectively used for this type of California cover lasting with the result of increased production and/or reduction in cost with the wet latex lasting system described in United States application Ser. No. 529,458, if a primer or thin layer of compatible cement dissolved in hydrocarbon solvents is first applied to the bottom surface of the insole member and dried. This primer or adhesive can be applied to the insole board and dried in a very efficient manner prior to the die cutting of the insole blank.

The cost of the priming adhesive on the insole and its application to the insole board and the cost of the wet latex as applied by the lasting machine is far less than the cost of hot melt and gives a more flexible joint than hot melt cement.

When compared to the spraying of latex peripherally around the insole lasting margin and the upstanding lasting margin of the cover, the use of the primed insole and the wet latex machine and method materially reduces the handling and cost. With the spraying of the latex, it is necessary for an operator to pick up each shoe in turn and traverse the entire lasting margin relative to the nozzle of a treadle-actuated or trigger-actuated spray gun. To apply a uniform layer of latex in this fashion requires time and skill and requires that the shoe be stored on a rack for a sufficient length of time for the latex to dry before it can be lasted with a roll-type lasting machine.

With the precoating of the insole and direct application of wet latex to the cover during the lasting operation, this double handling and drying time is eliminated. The resulting bond of the cover to the cemented insole is the same as with the presently sprayed latex.

SUMMARY OF THE INVENTION

The method as herein illustrated for making shoes comprising assembling of a form an upper and a bottom member, the latter being provided on its exposed surface, at least along its margin, with a coating of dried cement, progressively lasting the lasting margin of the upper relative to the bottom and wiping it inwardly into engagement with the dried adhesive coating along the marginal edge of the insole and while effecting such lasting applying a uniformly thick layer of liquid latex to the inner side of the lasting margin in a controlled amount. The shoe may be of the kind wherein a sock lining and wrapper are attached to the upper and the assembly comprising the upper, sock lining and wrapper are slip lasted onto a form whereupon an insole member is placed against the bottom of the sock lining and the wrapper is lasted about the edge of the insole member onto its exposed surface. The coating of the insole member preferably is accomplished by providing a sheet of inner sole material, coating the entire surface with an adhesive, allowing the coating to dry and then die-cutting the insole members from the sheet. The adhesive can be a compatible solvent adhesive, natural rubber latex or dissolved rubber or the like. A satisfactory adhesive is natural rubber of 2–5% solid dissolved in toluene, trichlorethylene or methylene chloride.

The lasting is preferably accomplished on the lasting machine disclosed in application Ser. No. 529,458, filed Dec. 4, 1974, referred to heretofore, wherein the lasting margin is gripped and advanced by means of cooperating gripping and feeding rolls which pull the lasting margin upwardly relative to the bottom of the insole member and then wiped inwardly over the margin edge of the bottom by wiping means in the form of a roller which rotates about an axis parallel to the bottom of the insole member. During the pulling over and wiping operation and just before the margin is folded inwardly by the wiping means, a uniform layer wet latex is applied to the inner side of the lasting margin in a controlled amount so that there is neither too much latex nor too little.

The invention will now be described with reference to the accompanying drawings, wherein.

Figure 8:
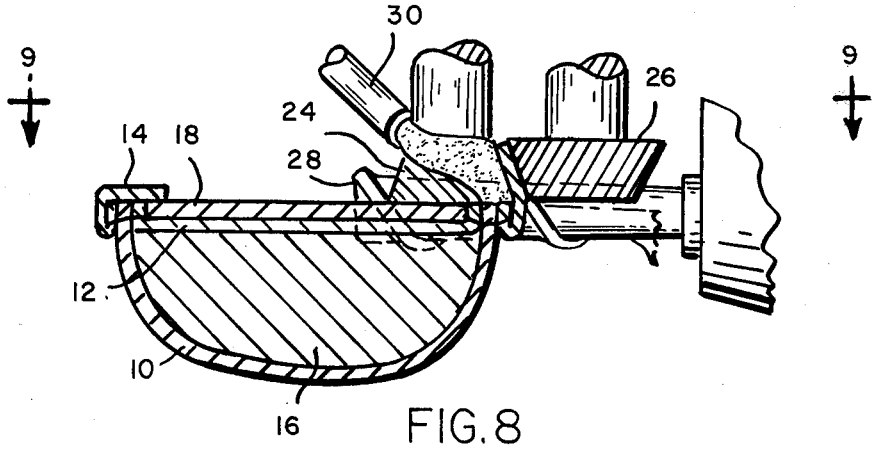
Figure 9:
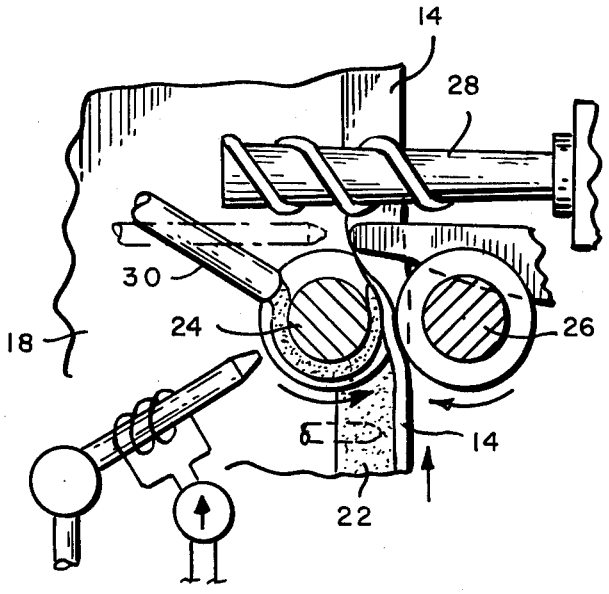

FIG. 8 is a fragmentary vertical section through the last showing the lasting instrumentality engaged with the edge of the wrapper and showing the application of the liquid adhesive to the inner surface of the wrapper; and FIG. 9 is a plan view showing the engagement of the lasting instrumentality with the margin of the wrapper and the application of a liquid latex to the inner surface of the wrapper.

Figure 1:
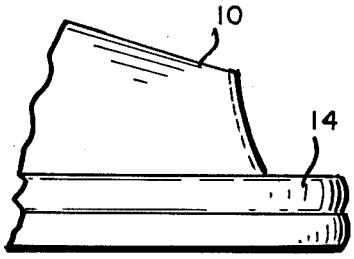
FIG. 1 is a fragmentary elevation of the forepart of a shoe made according to the method disclosed herein.
Figure 2:
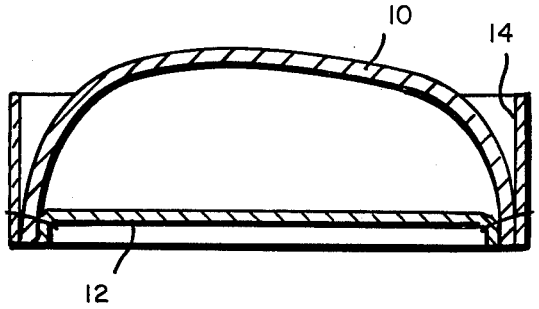
FIG. 2 is a cross section through the upper assembly of a shoe such as the shoe in FIG. 1 comprising an upper to which a sock lining and wrapper are stitched, but without a platform or innersole.
Figure 3:
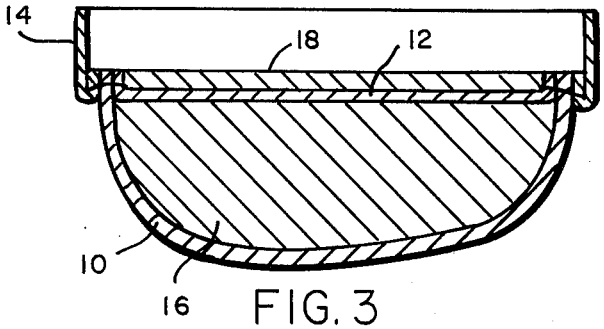
FIG. 3 is a section of the upper assembly shown in FIG. 2 mounted on a form or last with the wrapper folded upwardly relative to the bottom and with an insole member placed on the sock lining within the upturned wrapper.
Figure 7:
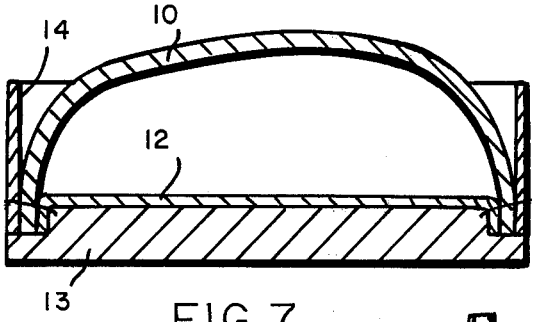
FIG. 7 is a section corresponding to FIG. 2 wherein the sock lining is provided with a platform.

Referring to the drawings, FIG. 1 shows a portion at the forepart of a shoe made according to the invention and FIG. 2 shows in section the upper assembly comprising an upper member 10 to which there is stitched a sock lining 12 and a wrapper 14. The upper assembly as shown in FIG. 2 is slip lasted onto a form or last 16 FIG. 3 whereupon the wrapper 14 is folded upwardly relative to the bottom of the last and an insole member 17 is deposited on the bottom within the sock lining and within the upwardly folded wrapper. Optionally, shown in FIG. 7, there may be a platform 13 in addition to the sock lining 12.

Figure 4:
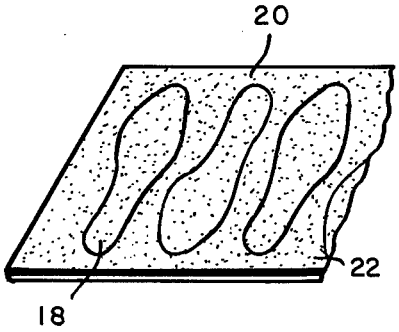
FIG. 4 is a plan view of a sheet of insole material which has been coated with a layer of adhesive which has been dried and from which a plurality of insole members are adapted to be die cut.
Figure 5:
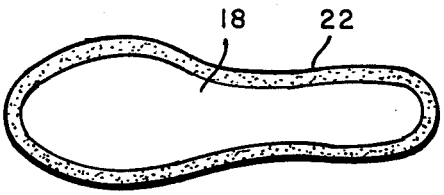
FIG. 5 is a plan view of a single insole coated marginally with a band of dried adhesive.

The insole members 18 are prepared as shown in FIG. 4 by the over-all coating of a sheet of insole material 20 with an adhesive 22 which has been spread onto the sheet 20 and allowed to dry, whereupon the insole members 18 are die cut from the sheet in such a way as to avoid waste of material. The sheet may be an insole strip which has fiberboard at the shank and heel and at the toe for reinforcement (4A and 4B). Optionally, the insole member may be cut from uncoated insole material and coated marginally as shown in FIG. 5 or all over.

Figure 6:
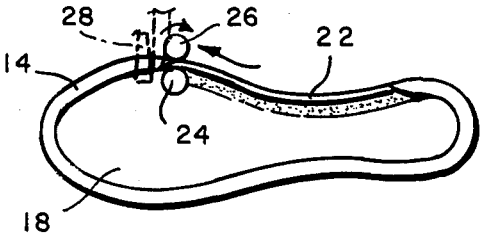
FIG. 6 is a plan view of a last with an upper assembly an insole member thereon showing diagrammatically the gripper rolls by means of which the wrapper is stressed heightwise on the bottom and the wiper by means of which the stressed wrapper is laid down against the insole.
Figure 4A:
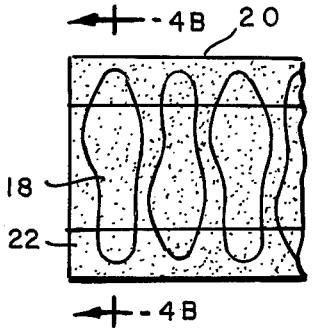
FIGS. 4A and 4B show plan and edge views of insole material with reinforcement at the toe and heel.
Figure 4B:
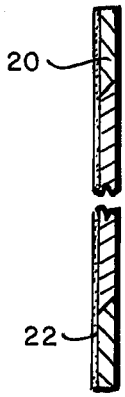

The shoe assembly is lasted on a machine of the kind shown in FIGS. 6, 8 and 9 for lasting of the wrapper into adhesive engagement with the marginal edge of the insole member. The aforesaid machine is described in detail in application Ser. No. 529,458, referred to above and comprises as shown in the accompanying figures feed rolls 24 and 26, a wiper 28 and a nozzle 30 for supplying adhesive to the feed roll which has contact with the inner side of the upper. The last with the upper and insole thereon is presented to the lasting machine by introducing the margin of the wrapper between the feed rolls whereupon by traversing the shoe relative to the feed rolls and beneath the wiper the lasting margin is pulled upwardly and folded inwardly under stress against the bottom or exposed surface of the insole member. Just before the margin of the wrapper is laid down liquid latex adhesive is supplied thereto in controlled amounts from the nozzle 30 which supplies the liquid latex to the surface of the feed roll 24 in the manner described in the aforesaid application. A liquid latex containing a high solid content is desirable, for example a solid content of 40–60 percent by weight.

While the method has been described with reference to a slip lasted type of shoe it is within the scope of the invention to last the lasting margin of a conventional upper to an insole by precoating the marginal edge of the insole with an adhesive, allowing it to dry, depositing the coated insole on the bottom of the last within the lasting margin of the upper and then lasting the lasting margin inwardly against the bottom of the insole with an apparatus such as described above.

It is to be understood that the present disclosure is for the purpose of illustration only and includes all modifications or improvements which fall within the scope of the appended claims.

We claim:

1. The method of lasting a cover strip to the insole at the bottom of a shoe upper provided with a sock lining turned down at the edge of the insole and stitched to the lower edge of the upper and the upper folded edge of the cover strip, and wherein said insole is fiberboard material, comprising lasting the unattached portion of the cover strip about the edge of the insole onto the bottom with latex applied to the cover strip in a uniformly thick, partially coagulated adhesive condition, characterized in that a uniformly thick prime coating of compatible rubber adhesive dissolved in a hydrocarbon solvent is applied to the marginal edge of the insole and allowed to dry prior to lasting the cover strip thereto.

2. The method according to claim 1 wherein said rubber cement comprises 2 to 5 percent solid dissolved in a hydrocarbon solvent.

3. The method of lasting the lasting margin of a shoe upper to the insole at the bottom of the shoe upper with latex as the adhesive and wherein said insole is fiberboard, comprising applying a thin prime coating of rubber cement to the margin of the insole and allowing it to dry and thereafter lasting the lasting margin of the upper to the insole with the aid of a progressive-type lasting machine with latex applied to the lasting margin as it is stressed by the lasting instrumentalities in a partially coagulated adhesive condition.

4. The method according to claim 3 wherein the rubber cement comprises 2 to 5 percent solid dissolved in a hydrocarbon solvent.

* * * * *